US006571076B2

(12) United States Patent
Kasahara et al.

(10) Patent No.: US 6,571,076 B2
(45) Date of Patent: May 27, 2003

(54) IMAGE FORMING APPARATUS AND TONER CONTAINER THEREFOR

(75) Inventors: Nobuo Kasahara, Kanagawa (JP); Satoshi Muramatsu, Kanagawa (JP); Junichi Matsumoto, Kanagawa (JP); Nobuo Iwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/801,806

(22) Filed: Mar. 9, 2001

(65) Prior Publication Data

US 2001/0052526 A1 Dec. 20, 2001

(30) Foreign Application Priority Data

Mar. 10, 2000 (JP) ..... 2000-067619
Jan. 25, 2001 (JP) ..... 2001-017037

(51) Int. Cl.[7] ..... G03G 15/08
(52) U.S. Cl. ..... 399/258; 399/262
(58) Field of Search ..... 399/262, 258, 399/254; 222/95, 207, 335, DIG. 1, 92, 107

(56) References Cited

U.S. PATENT DOCUMENTS 5,074,342 A * 12/1991 Kraehn ..... 399/258 X
5,195,655 A * 3/1993 Bukhman ..... 222/95 X
5,386,274 A 1/1995 Sanpe et al.
5,663,788 A 9/1997 Sanpe
5,875,380 A 2/1999 Iwata et al.
5,953,567 A 9/1999 Muramatsu et al.
5,960,246 A 9/1999 Kasahara et al.
5,962,783 A 10/1999 Iwata et al.
5,987,298 A 11/1999 Muramatsu et al.
6,112,046 A 8/2000 Suzuki et al.
6,128,459 A 10/2000 Iwata et al.
6,142,690 A 11/2000 Yoshimura et al.
6,163,669 A 12/2000 Aoki et al.
6,201,941 B1 3/2001 Kasahara et al.
6,282,396 B1 8/2001 Iwata et al.
6,295,437 B1 9/2001 Hodoshima et al.
6,304,739 B1 * 10/2001 Katsuyama et al. ..... 399/262
6,381,435 B2 4/2002 Shinohara et al.
6,393,241 B1 5/2002 Matsumoto et al.

FOREIGN PATENT DOCUMENTS

JP 2000-047464 2/2000

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A toner container for an image forming apparatus is made up of a deformable, hermetic bag packed with toner and a box accommodating the bag. A mouth member is affixed to the bag. A powder pump sucks the toner out of the bag and replenishes it to a developing device included in the image forming apparatus. After the toner container has run out of toner, it can be transported or otherwise dealt with at an extremely low cost. In addition, the toner preserves its property despite the delivery to the developing device.

13 Claims, 16 Drawing Sheets

IMAGE FORMING APPARATUS AND TONER CONTAINER THEREFOR

BACKGROUND OF THE INVENTION

The present invention relates to an image forming apparatus and more particularly to a toner container for replenishing fresh toner to a developing device included in an image forming apparatus via a toner replenishing device.

It is a common practice with a printer, facsimile apparatus, copier or similar electrostatic image forming apparatus to removably mount a toner container to the body of the apparatus in order to replenish fresh toner to a developing device. The toner container is implemented as a bottle, cartridge or similar hard case. A hard case, however, brings about a problem in the recycling aspect when emptied and replaced. Specifically, while the used toner container is usually collected from the user's station by the manufacturer and recycled, reused or burned, the hard case is bulky and increases the collection and distribution cost to the manufacturer. Further, when the collected hard case is reused, it is difficult to clean the case and to efficiently pack the cleaned case with toner, also resulting in a high cost.

A toner container whose volume can be reduced has been proposed in the past. This kind of toner container, however, cannot stably discharge toner. This, coupled with various limitations on toner conveyance, is apt to bring about contamination at the time of replacement of the toner container. Moreover, a toner replenishing device is limited in location and cannot stably replenish toner over a long period of time.

Toner conveyance has customarily relied on mechanical auger means. It follows that the toner replenishing device and toner container must be unitary with or must be positioned in the vicinity of the developing device. This complicates the configuration of the toner replenishing device and thereby increases the cost while degrading productivity and obstructing maintenance. Moreover, it is difficult to preserve the expected property of toner. In addition, the toner container cannot be easily replaced by the user.

Technologies relating to the present invention are disclosed in, e.g., Japanese Patent Laid-Open Publication No. 2000-47464.

SUMMARY OF THE INVENTION

It is therefore an object of the present invention to provide an image forming apparatus capable of noticeably reducing the transport cost of a used toner container while preserving the property of toner despite conveyance, and a toner container for the same.

In accordance with the present invention, an image forming apparatus includes a developing device for developing a latent image formed on an image carrier with toner, and a toner replenishing device for replenishing toner from a toner container to the developing device. The toner container is deformable and hermetic and formed with a toner outlet. The toner replenishing device includes a sucking device for sucking the toner out of the toner container, while causing the walls of the toner container to move in such a manner as to reduce the volume of the toner container.

Further, in accordance with the present invention, in a toner container for an image forming apparatus including a developing device for developing a latent image formed on an image carrier with toner, and a toner replenishing device for replenishing toner from said toner container to the developing device, the toner container includes a body. The toner replenishing device includes a sucking device for sucking toner out of the body, which is hermetic and deformable when subjected to the suction of the sucking device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
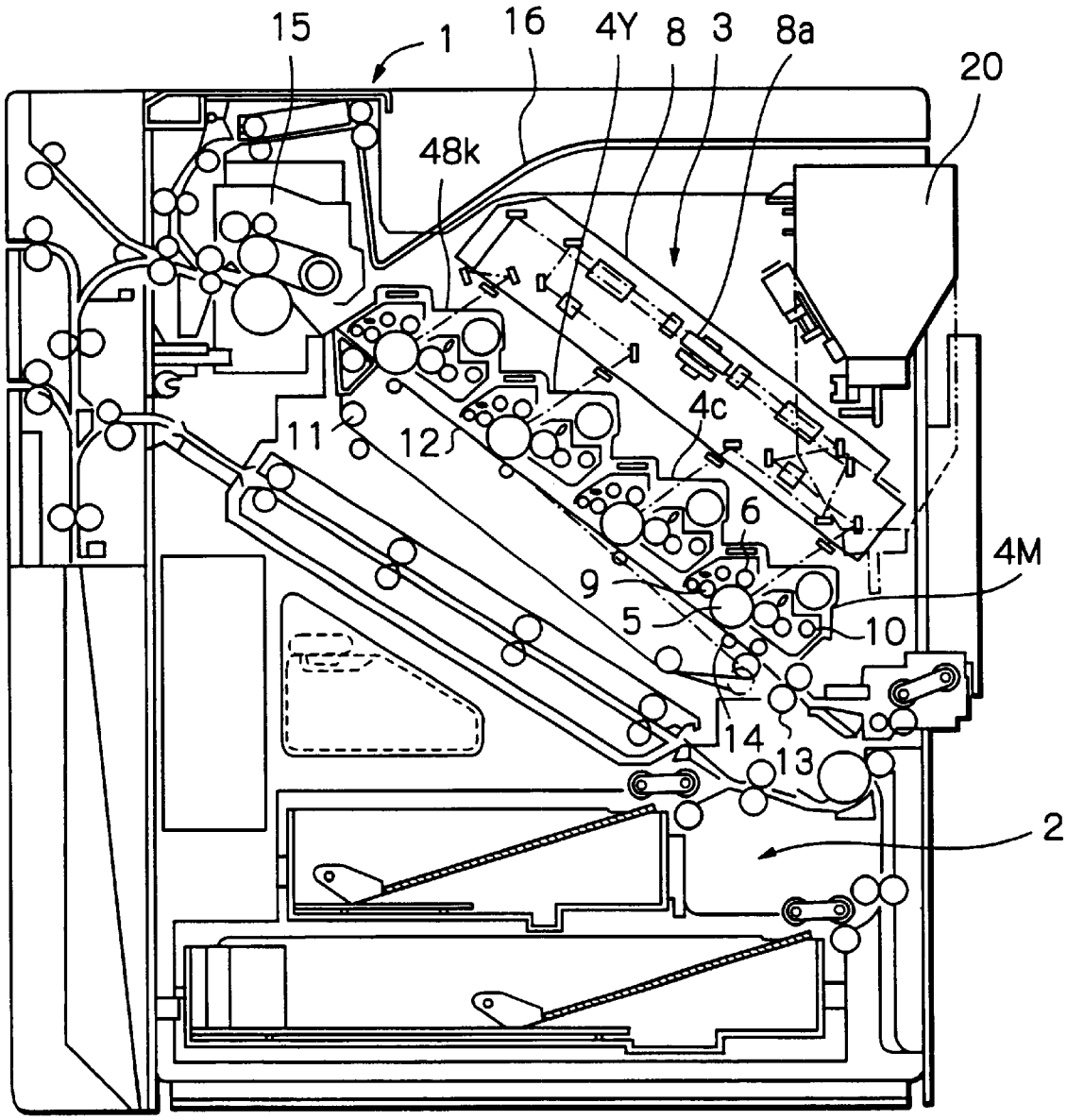
FIG. 1 is a view showing the general construction of an image forming apparatus embodying the present invention and implemented as a color laser printer by way of example.

Referring to FIG. 1 of the drawings, an image forming apparatus embodying the present invention is shown and implemented as a color laser printer by way of example. As shown, the color laser printer includes a casing 1 accommodating a paper feeding section 2 in a lower portion thereof. An image forming section is arranged above the paper feeding section 2 and includes a belt device generally inclined such that a paper outlet end is positioned at a higher level than a paper inlet end. The belt device includes a plurality of (four in the illustrative embodiment) rollers 11 and an endless image transfer belt 12 passed over the rollers 11. Four image forming units 4M (magenta), 4C (cyan), 4Y (yellow) and 4Bk (black) are sequentially arranged along the upper run of the image transfer belt 12 in this order.

Figure 2:
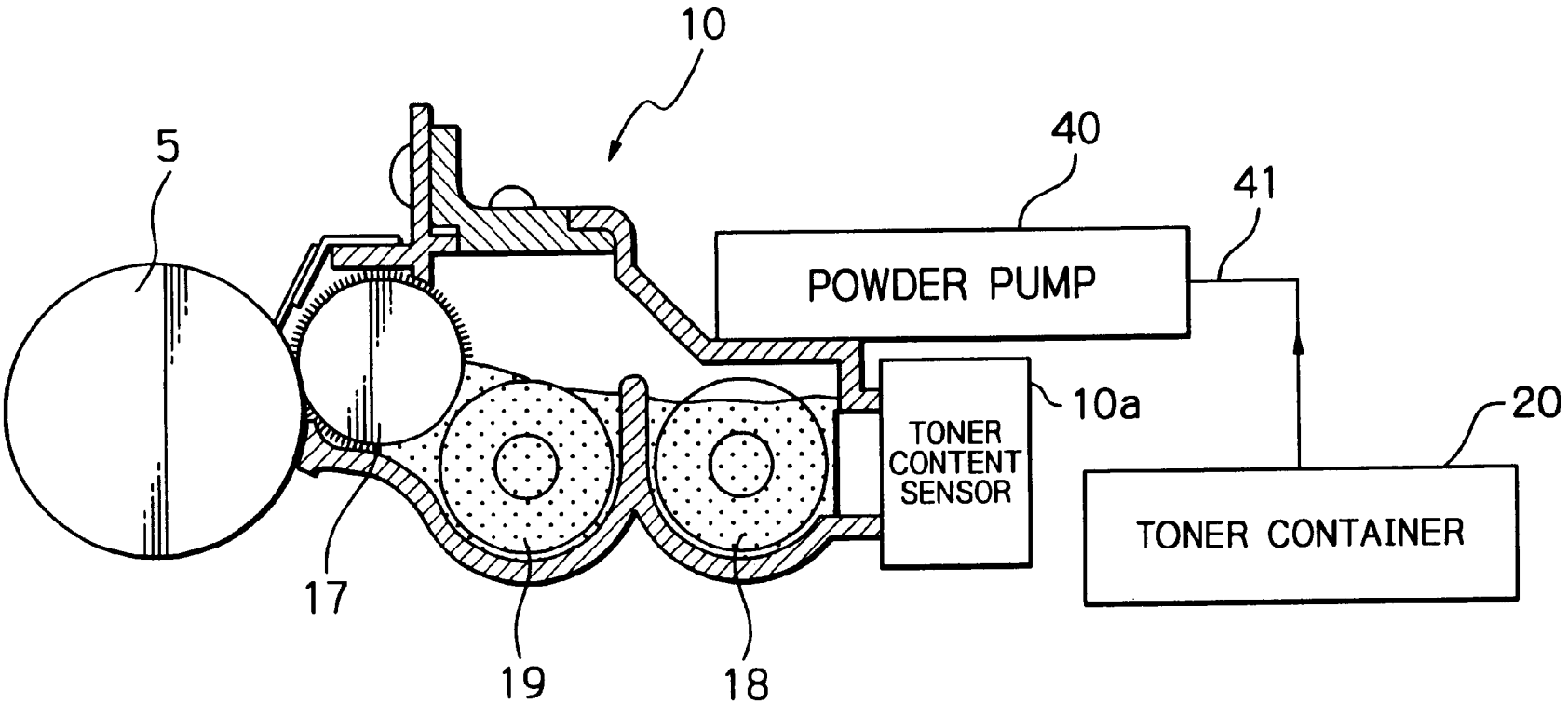
FIG. 2 is a schematic block diagram showing a toner replenishing section included in the illustrative embodiment.

As also shown in FIG. 2, the image forming units 4M through 4Bk each include a photoconductive drum 5, which is a specific form of an image carrier. Drive means, not shown, causes the drum 5 to rotate clockwise, as viewed in FIGS. 1 and 2. Arranged around the drum 5 are a charge roller or charging means 6, an optical writing section, a developing device or developing means 10, and a cleaning device or cleaning means 9. At the optical writing section, a laser beam issuing from an optical writing unit 8 optically writes an image on the drum 5. The developing device 10 stores a toner and carrier mixture, i.e., a two-ingredient type developer therein. A toner replenishing device, which will be described later, replenishes fresh toner to the developing device 10, as needed.

A full-color print mode available with the printer of FIG. 1 will be described hereinafter, taking the image forming unit 4M as an example. The charge roller 6 uniformly charges the surface of the drum 5, which is in rotation. In the optical writing unit 8, a laser diode, not shown, is driven to emit a laser beam in accordance with image data. The laser beam is incident to the drum 5 via a polygonal mirror 8*a* and a cylindrical lens not shown. As a result, a latent image represented by the image data is electrostatically formed on the drum 5. The image data are output from a personal computer or similar host machine. The developing device 10 develops the latent image with magenta toner to thereby form a magenta toner image.

The paper feeding section 2 feeds a paper sheet or similar recording medium toward a registration roller pair 13 located upstream of the image transfer belt 12 in the direction of paper feed. The registration roller pair 13 once stops the paper sheet and then drives it toward the belt 12 at such a timing that the leading edge of the paper sheet meets the leading edge of the magenta toner image. The belt 12 conveys the paper sheet to an image transfer position where the drum 5 is positioned. At the image transfer position, an image transfer roller 14 that faces the rear surface of the belt 12 transfers the magenta toner image to the paper sheet.

The other image forming units 4C, 4Y and 4Bk respectively form a cyan toner image, a yellow toner image and a black toner image on the respective rollers 5 in the same manner as the image forming unit 4M forms the magenta toner image. The cyan, yellow and black toner images are sequentially transferred to the paper sheet being conveyed by the drum 12 over the magenta toner image. The printer can therefore form a full-color image on the paper sheet as rapidly as a monochromatic image. The paper sheet with the full-color image, or print, is separated from the belt 12 and has the full-color image fixed by a fixing unit 15. The print coming out of the fixing unit 15 is simply driven out of the casing 1 or is turned over and then driven to a tray 16 face down, i.e., with the image surface facing downward. The tray 16 is positioned on the top of the casing 1. Face-down paper discharge is substantially essential when prints should be stacked in order of page.

Figure 3:
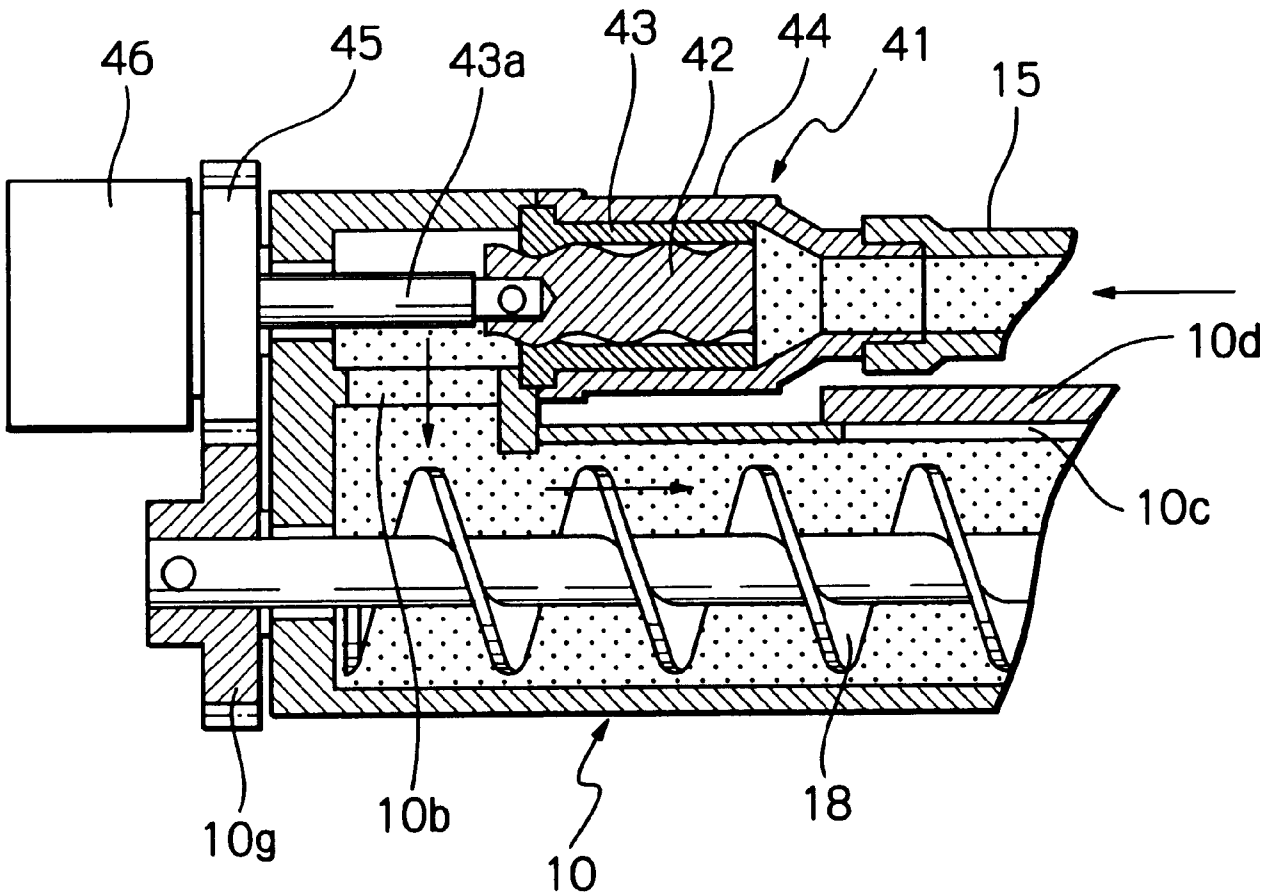
FIG. 3 is a fragmentary section showing part of the toner replenishing device adjoining one end of a developing device.
Figure 4:
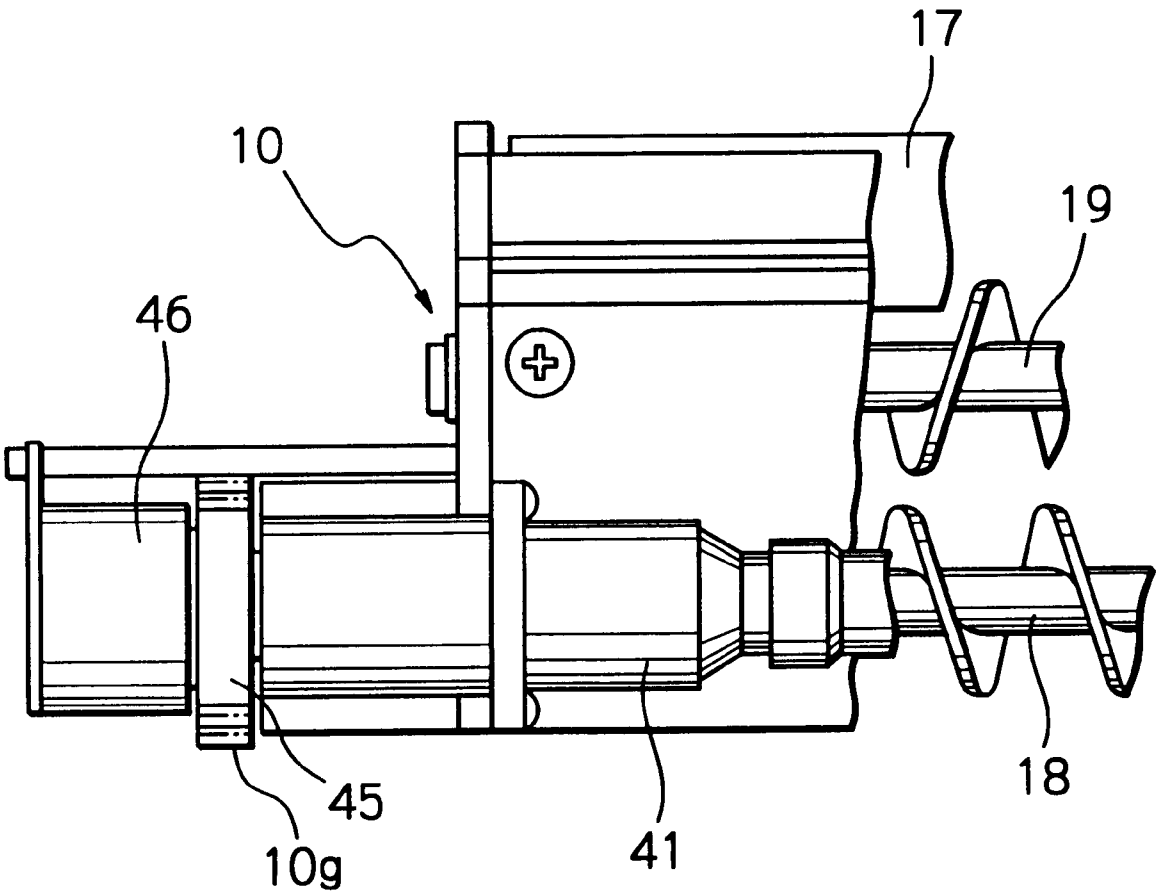
FIG. 4 is a plan view of the developing device.
Figure 5:
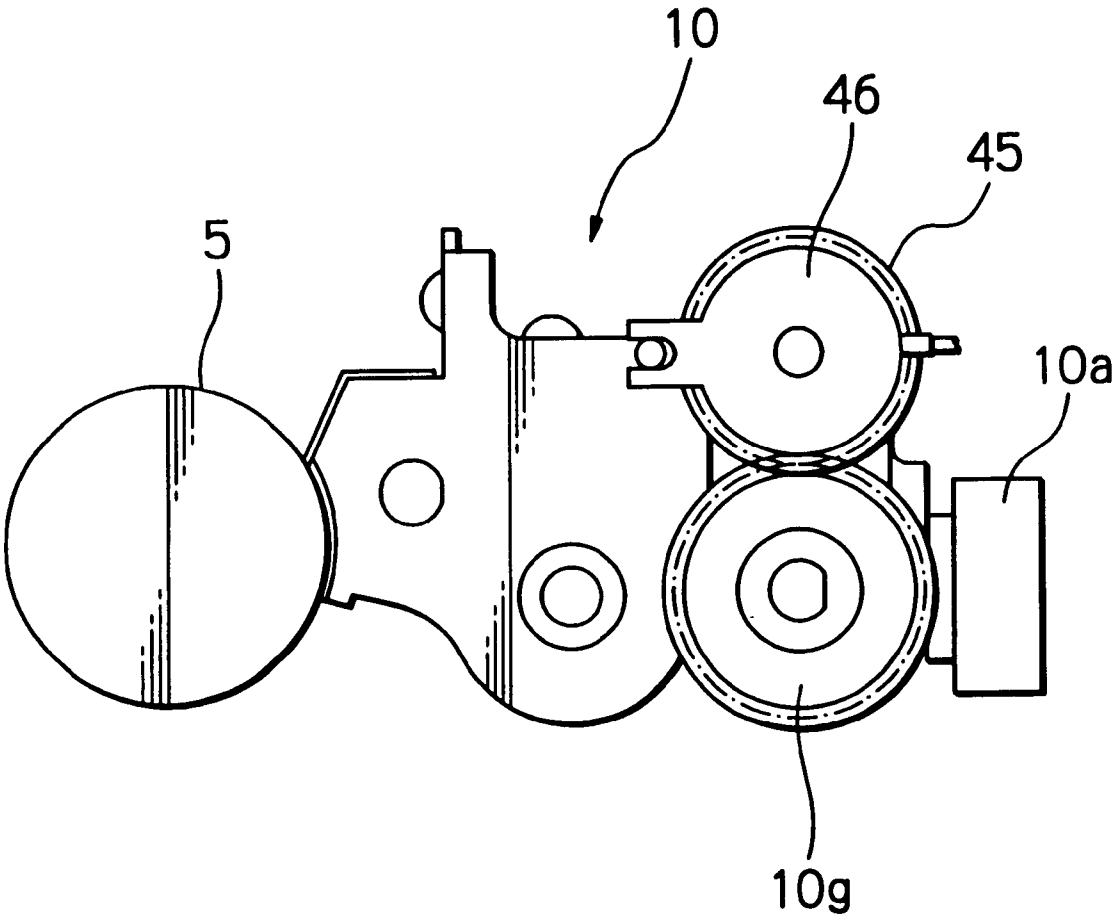
FIG. 5 is a side elevation of the developing device.

As shown in FIG. 2, the paper replenishing device includes a toner container 20 removably mounted to the printer. A powder pump or sucking means 40 sucks toner packed in the toner container 20 and delivers it to the developing device 10 via a tube 41. As shown in FIGS. 2 through 4, the developing device 10 includes a developing sleeve 17 facing the drum 5 and a first and a second screws or agitators 18 and 19. The first screw 18 conveys a developer existing in the developing device 10 from the left to the right, as viewed in FIG. 4, while the second screw 19 conveys it from the right to the left. As a result, the developer is circulated in the developing device 10. The developer in circulation is deposited on the developing sleeve 17 and then transferred from the sleeve 17 to the drum 5, developing the latent image formed on the drum 5. A toner content sensor 10*a* shown in FIG. 2 senses the toner content of the developer present in the developing device 10 in terms of permeability.

As shown in FIG. 2, the toner replenishing device includes a toner container 20 removably mounted to the printer. A powder pump or sucking means 40 sucks toner packed in the toner container 20 and delivers it to the developing device 10 via a tube 41. As shown in FIGS. 2 through 4, the developing device 10 includes a developing sleeve 17 facing the drum 5 and a first and a second screws or agitators 18 and 19. The first screw 18 conveys a developer existing in the developing device 10 from the left to the right, as viewed in FIG. 4, while the second screw 19 conveys it from the right to the left. As a result, the developer is circulated in the developing device 10. The developer in circulation is deposited on the developing sleeve 17 and then transferred from the sleeve 17 to the drum 5, developing the latent image formed on the drum 5. A toner content sensor 10*a* shown in FIG. 2 senses the toner content of the developer present in the developing device 10 in terms of permeability.

The first and second screws 18 and 19 are constantly rotated during image formation. Therefore, if the powder pump 40 and first screw 18 are constructed and driven integrally with each other, then the toner will be replenished when the screw 18 is driven. This kind of configuration is not applicable to a developing device of the type replenishing toner on the basis of the toner content of a developer.

In light of the above, in the illustrative embodiment, the solenoid-operated clutch 46 controls drive transmission to the powder pump 40. This allows the toner content of the developer in the developing device 10 to be maintained constant. More specifically, the toner content sensor or permeability sensor 10*a* included in the developing device 10 is responsive to the variation of the toner and carrier mixture ratio of the developer. When the output of the toner content sensor 10*a* shows that the content is short, the clutch 46 is coupled to activate the powder pump 40 with the result that fresh toner is replenished from the toner container 20 to the developing device 10. As soon as the preselected toner content is restored, the clutch 46 is uncoupled to deactivate the powder pump 40. Consequently, toner is not replenished to the developing device 10 despite that the first screw 18 is continuously rotated. If desired, the amount of toner to be replenished may be controlled in accordance with the density of reflection from the toner image formed on the drum 5.

The powder pump 40 is capable of sucking toner from the toner container 20 because of the rotation of the rotor 42. The toner is introduced into a toner passage 10*b* formed between the pump 40 and the first screw 18 and then delivered to the developing device 10. As for the two-ingredient type toner, the toner delivered from the pump 40 to the developing device 10 is mixed with the developer existing in the device 10 while being agitated. The replenished toner provides the developer with the preselected toner content and is provided with an adequate amount of charge itself. The developing device 10 additionally includes an exhaust port 10*c* and a filter 10*d* covering the exhaust port 10*c*. Only air is discharged via the exhaust port 10*c* and filter 10*d*. This successfully obviates pressure elevation in the developing device 10 during development and thereby insures stable toner replenishment while preventing the toner from flying out of the device 10. The tube 41 is connected to the inlet of the pump 40 and preferably formed of toner-resistant elastic material, e.g., polyurethane rubber, nitril rubber, EPDM, silicone rubber or similar rubber. The tube 41 may have a diameter of 4 mm to 10 mm by way of example.

Figure 6:
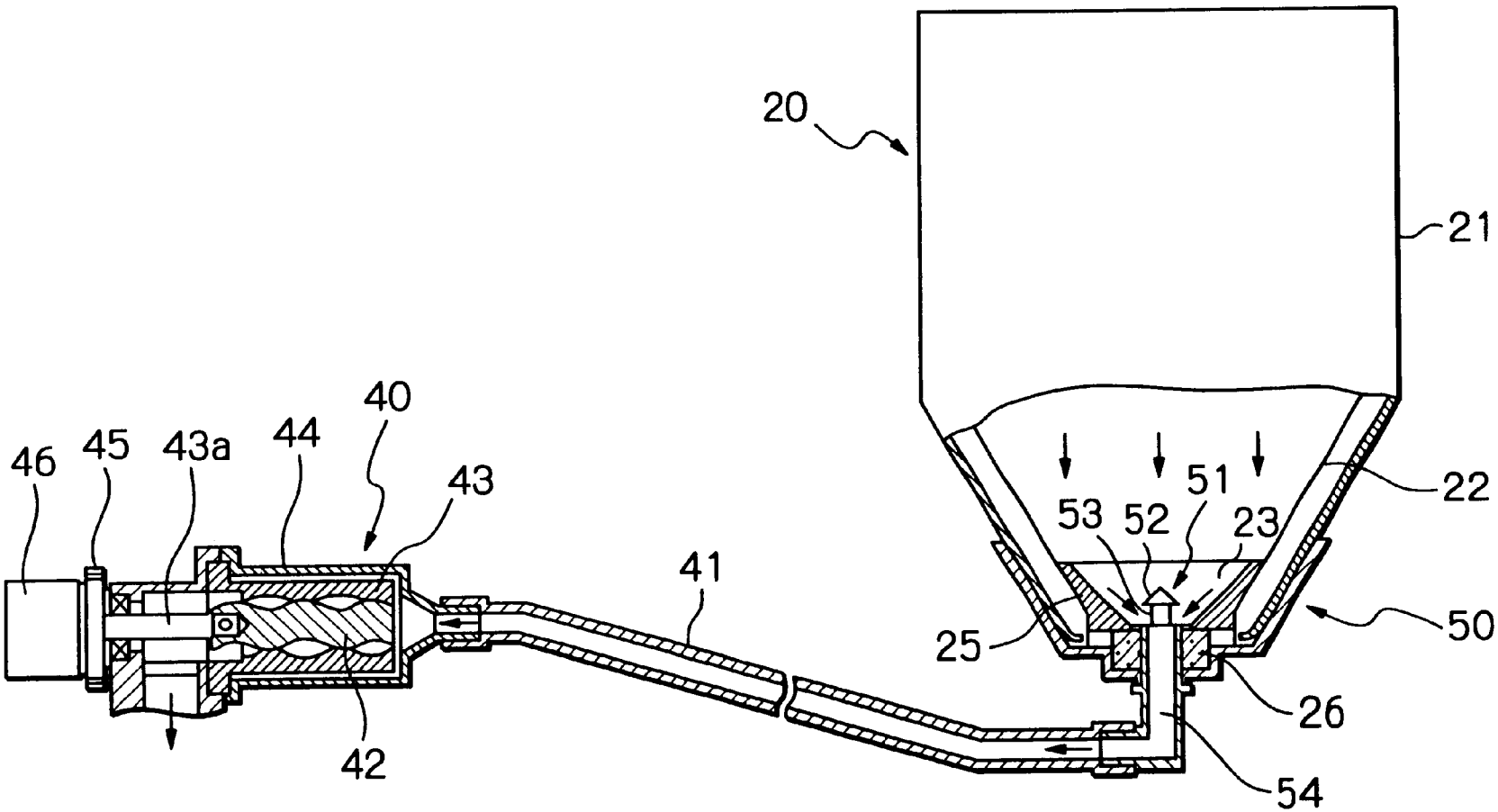
FIG. 6 is a section showing a toner replenishing mechanism unique to the illustrative embodiment.

FIG. 6 shows essential part of the toner replenishing mechanism included in the illustrative embodiment. As shown, the toner container 20 is removably mounted to a mount portion 50 included in the printer. The mount portion 50 includes a substantially upright nozzle or insertion member 51 that penetrates into the toner container 20. The nozzle 51, which is hollow and cylindrical, is formed integrally with or removable from the mount portion 50, but located at a preselected position. The nozzle 51 has a tip portion 52 and a toner inlet 53 contiguous with the tip portion 52. A toner discharge passage 54 extends throughout the nozzle 51 and is communicated to the toner inlet 53. The tube 41 is connected to the end of the toner discharge passage 54.

As shown in FIGS. 6 and 7A through 7C, the toner container 20 has a bag-in-box type of configuration. Specifically, the toner container 20 is made up of a box or protection case 21 and a flexible, deformable bag 22 removably accommodated in the box 21. The bag 22 is packed with toner. The box 21 is formed of paper, corrugated cardboard, resin or similar material having rigidity. A space great enough to accommodate the bag 22 is formed in the box 21.

A mouth member or outlet member 23 is formed integrally with or adhered to the bottom center of the bag 22. The bag 22 is implemented by a flexible sheet or a laminate of flexible sheets formed of polyethylene, nylon or similar resin or paper. The bag 22 is about 80 $\mu$m to about 125 $\mu$m thick and framed in a paper folding fashion.

Figure 7C:
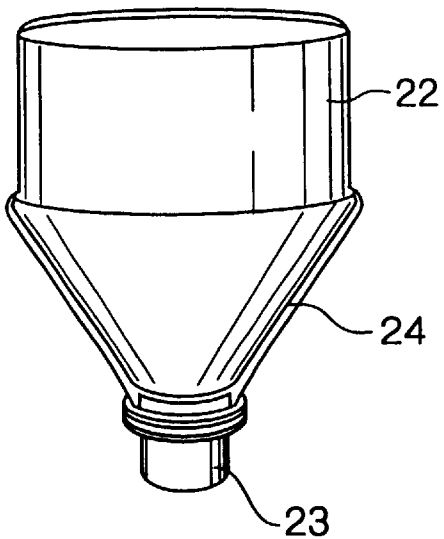
FIG. 7C is a view showing the appearance of a bag included in the toner container.

The bag 22 is tapered downward from its intermediate portion toward the mouth member 23, so that the toner can be easily discharged from the bag 22. Should the tapered portion of the bag 22 fold, then much toner would be left in the bag 22. To solve this problem, as shown in FIG. 7C, a sheet-like reinforcing member 24 is adhered or otherwise attached to the portion of the bag 22 above the mouth member 23. From the recycling standpoint, the reinforcing member 24 should preferably be formed of the same material as the bag 22, but thicker than the bag 22, or formed of the same material as the box 21. Further, aluminum may advantageously be deposited on the surface of the bag 22 and that of the reinforcing member 24 in order to cope with static electricity and moisture.

As shown in FIG. 6, the mouth member 23 is made up of a body 25 and a seal member 26. The body 25 is formed of polyethylene, nylon or similar resin and funnel-shaped toward an opening, which is formed at substantially the center of the body 25. The seal 26 is fitted in the opening of the body 25. To facilitate recycling, the body 25 should preferably be formed of a material identical with or belonging to the same series as the material of the sheets of the bag 22.

The seal member 26 is formed of foam sponge or similar elastic material and formed with a cruciform, through a slit at the center. When the toner container 20 is set on the mount portion 50, the nozzle 51 is inserting into the slit while forcing it to open. When the toner container 20 is removed from the mount portion 50 away from the nozzle 51, the slit restores its original position and again hermetically closes the bag 22. In this sense, the seal member 26 plays the role of a self-closing valve.

The box 21, which is rigid, allows the toner container 20 to be easily mounted and dismounted from the mount portion 50. In addition, the box 21 protects the bag 22 from damage and preserves the quality of the toner packed in the bag 22.

The mouth member 23 and bag 22 may, of course, be molded integrally with each other by blow molding or similar technology, if desired.

Figure 7B:
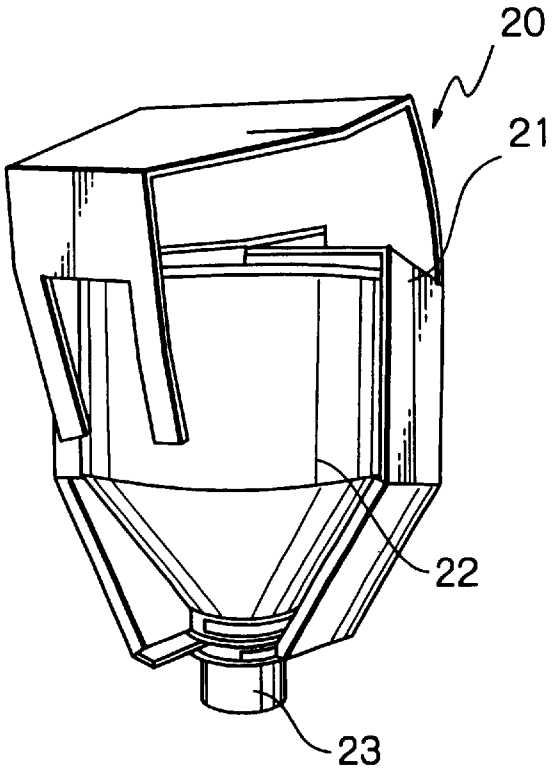
FIG. 7B is a view showing the toner container of FIG. 7A with part of a box being removed.
Figure 7A:
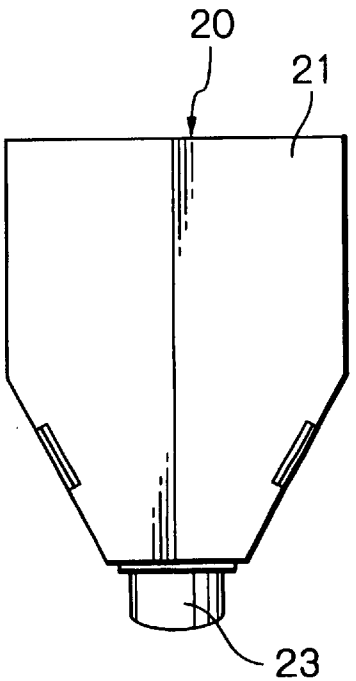
FIG. 7A is a view showing the appearance of a toner container included in the illustrative embodiment.

FIGS. 7B and 7C show the toner container 20 packed with the toner. When the toner is sucked out of the toner container 20 set on the mount portion 50, it flows in a direction indicated by arrows in FIG. 6 due to its own weight and the operation of the powder pump 40. The toner then flows to the powder pump 40 via the toner inlet 53 and toner discharge passage 54 of the nozzle 51 and tube 41. Consequently, the toner is replenished to the developing device 10 via the powder pump 40. Every time the toner is replenished, pressure inside the toner container 20 drops.

The flexible bag 22 of the toner container 20 is formed of a material that deforms when subjected to pressure lower than the suction pressure of the powder pump 40. The volume of the bag 22 therefore decreases in accordance with the above-mentioned pressure drop in order to balance the pressure inside the bag 22 and the atmospheric pressure.

Figure 8:
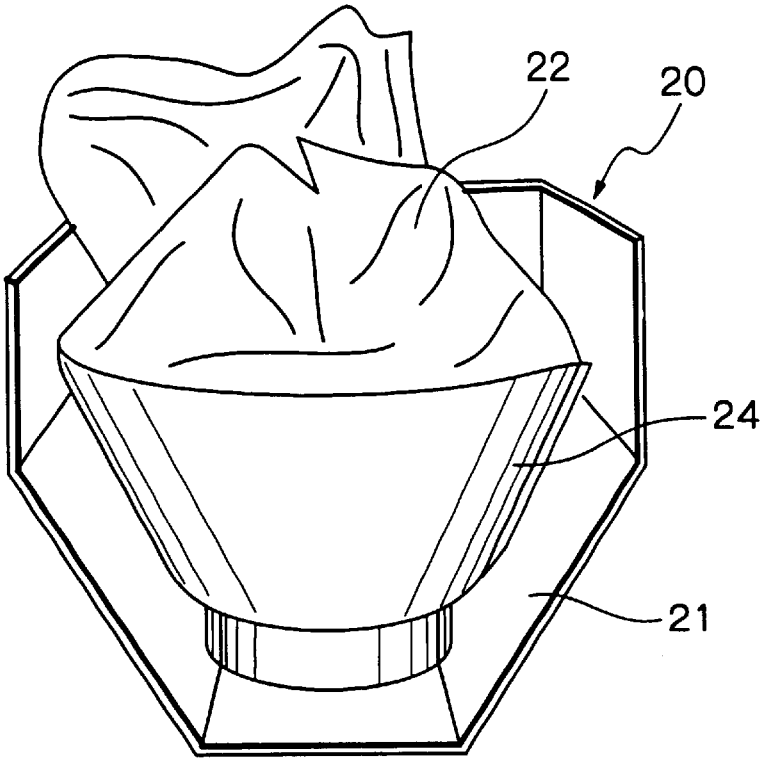
FIG. 8 is a view showing the toner container whose volume has been reduced.

The bag 22 is formed of a flexible material and provided with the sheet-like reinforcing member 24, as stated earlier. Therefore, repeated toner replenishment causes the bag 22 to decrease in volume such that its walls move. More specifically, as shown in FIG. 8, the bag 22 starts collapsing at its upper portion due to the drop of pressure inside the bag 22. As the volume of the bag 22 decreases, the reinforcing member 24 moves inward with its bottom serving as a fulcrum while preserving the shape. Consequently, the toner in the bag 22 smoothly flows because of the decreasing volume and its own weight without staying in the bag 22. At the same time, the toner fills up a space in the bag 22 from which the toner has been discharged.

The toner in the bag 22 is free from mechanical stresses that would cause the toner to cohere. Further, even toner low in fluidity does not bridge in the toner container 20. The property of the toner can therefore be maintained stable without regard to the amount of the toner existing in the bag 22, insuring stable toner replenishment at all times. Further, the entire toner can be discharged from the bag 22. Moreover, when the bag 22 is emptied, the volume of the bag 22 is far smaller than when packed with the toner.

The reinforcing member 24 moves inward with its lower portion serving as a fulcrum while preserving the shape, as stated above. The reinforcing member 24 therefore preserves the space in the lower portion of the bag 22 in the event of pressure drop and does not obstruct the discharge of the toner at all. Because the powder pump 40 causes a minimum of toner to remain in the bag 22, the toner container 20 is economical and can be safely, sanitarily handled after use. In addition, because the walls of the bag 22 move in the event of pressure drop, even the toner deposited on the walls is caused to drop toward the nozzle and-surely discharged.

The used toner container 20 can have its box 21 and bag 22 easily separated from each other. After the separation, the box 21 may be folded up or developed in the form of a single sheet. Also, the bag 22, which is flexible, is far smaller and therefore easier to handle than the conventional cartridge, bottle or similar hard case and occupies a minimum of space during transport or storage. The box 21 and bag 22 are collected from the user's station by the manufacturer and recycled, reused or burned. In this respect, the bag 22 can be easily rolled up or folded up because only the mouth member 23 is hard. This further enhances the easy transport and storage of the bag 22 while reducing the space to be allocated to the bag 22. In addition, the cost of collection of the bag 22 from the user's station is noticeably reduced.

Figure 9:
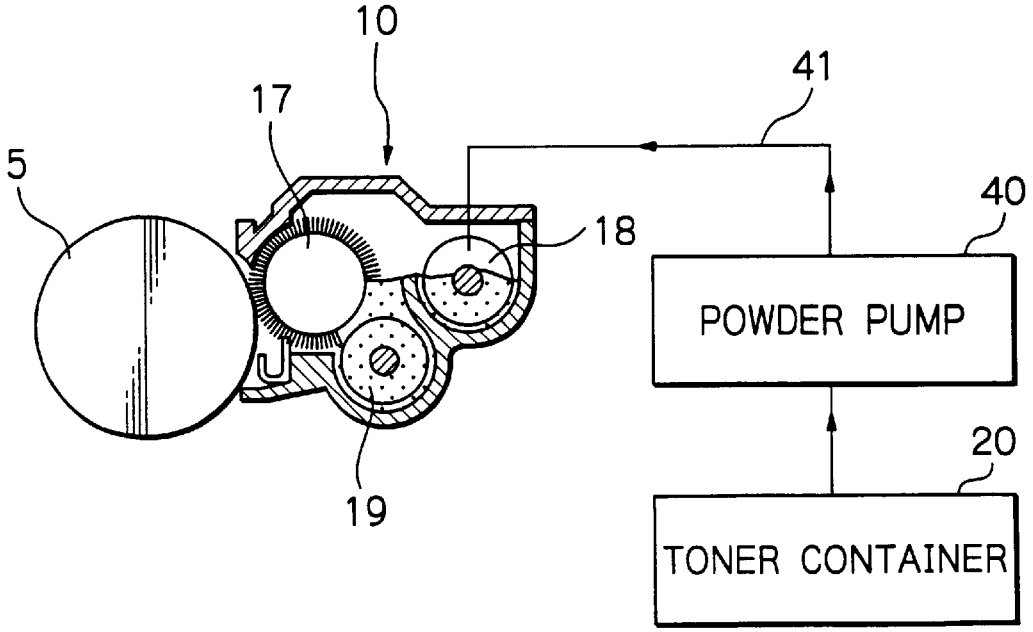
FIG. 9 is a schematic block diagram showing a toner replenishing device representative of an alternative embodiment of the present invention.
Figure 10:
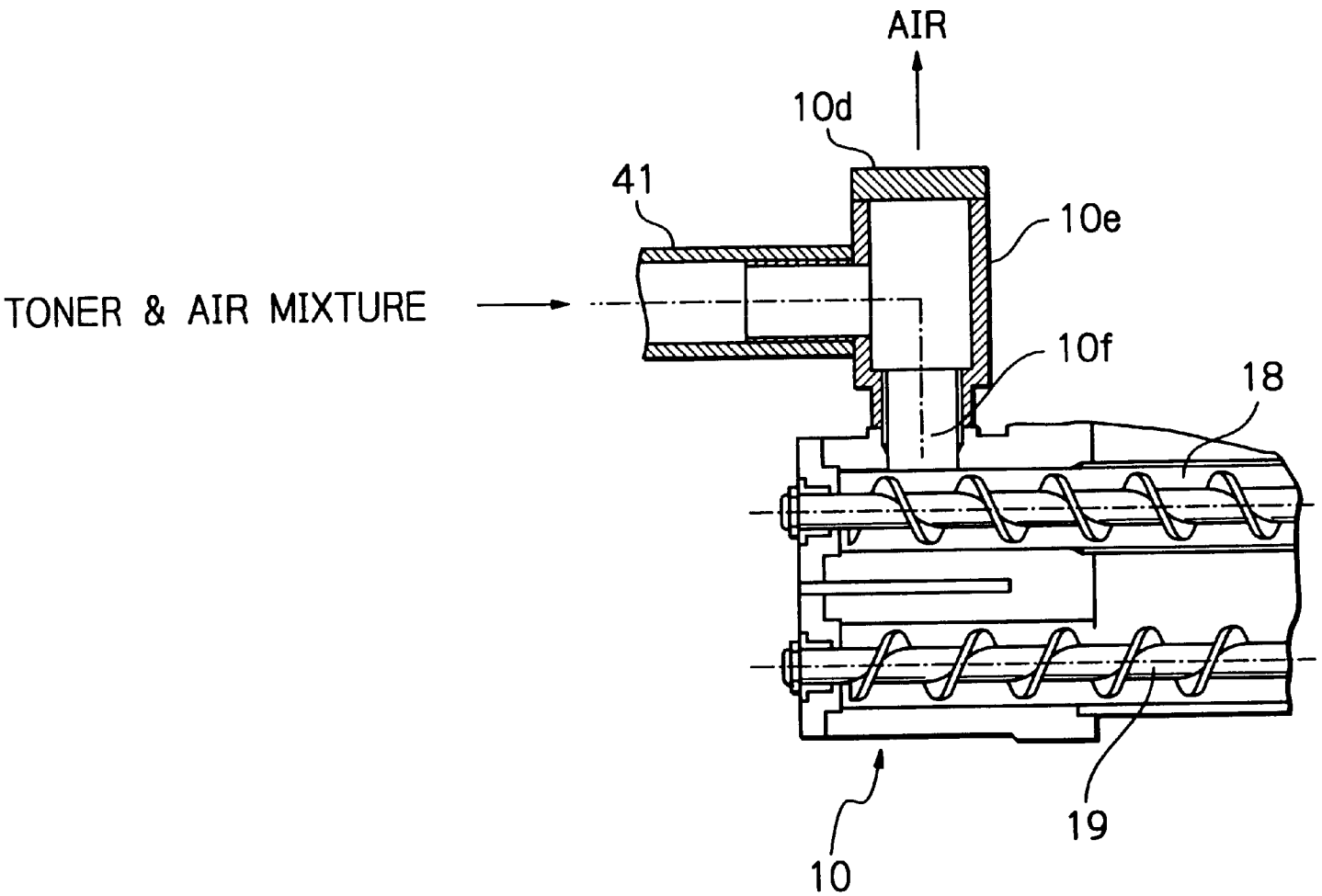
FIG. 10 is a fragmentary section showing part of a toner replenishing device included in the alternative embodiment and adjoining one end of a developing device.

Reference will be made to FIG. 9 for describing a toner replenishing device representative of an alternative embodiment of the present invention. FIG. 10 is a side elevation of a developing device shown in FIG. 9. In this embodiment, structural elements identical with the structural elements of the previous embodiment are designated by identical reference numerals.

As shown, the toner is replenished from the toner container to the developing device 10 via the powder pump 40 and tube 41 as in the previous embodiment. The developing sleeve 17 and screws 18 and 19 are disposed in the developing device 10. The screw 19 conveys the developer from the front to the rear in the direction perpendicular to the sheet surface of FIG. 9 while the screw 18 conveys it in the opposite direction. The developer in circulation is deposited on the developing sleeve 17 and then transferred to the drum 5 to thereby develop a latent image.

As shown in FIG. 10, a toner inlet 10*e* and a connecting member 10*f* communicated to the toner inlet 10*e* are located at the front end of the developing device 10 at a position corresponding to the screw 19. The tube 41 is connected to the connecting member 10*f*. An air filter 10*d* is fitted on the connecting member 10*f*. The air filter 10*d* passes only air therethrough that flows into the developing device 10 together with the toner. This prevents the toner from flying out of the connecting member 10*f* or the developing device 10. While the toner is shown as being replenished via one end of the developing device 10 in FIGS. 9 and 10, it may be replenished via any desired point of the developing device 10.

Figure 11:
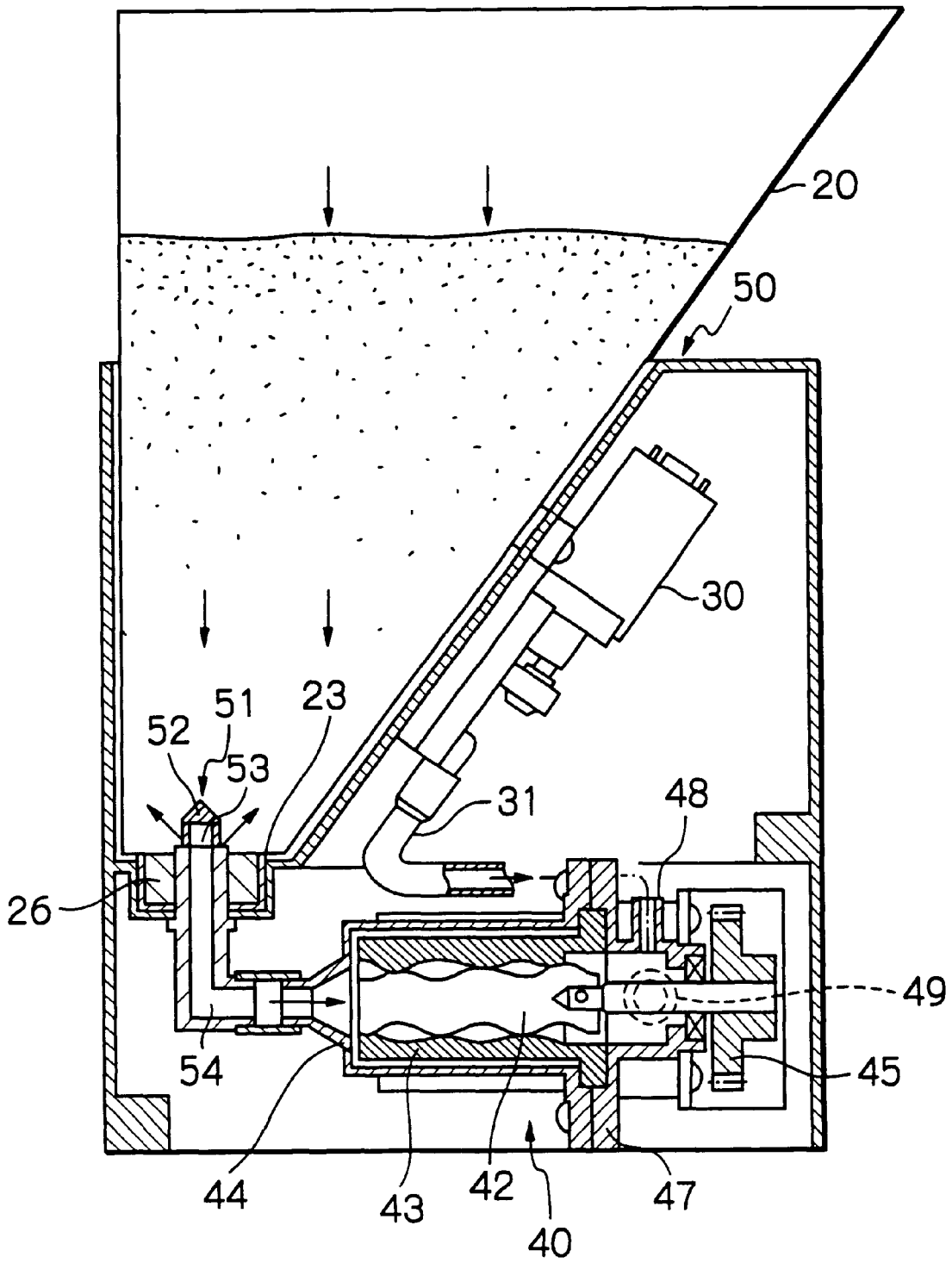
FIG. 11 is a section showing a toner replenishing device included in the alternative embodiment.
Figure 12A:
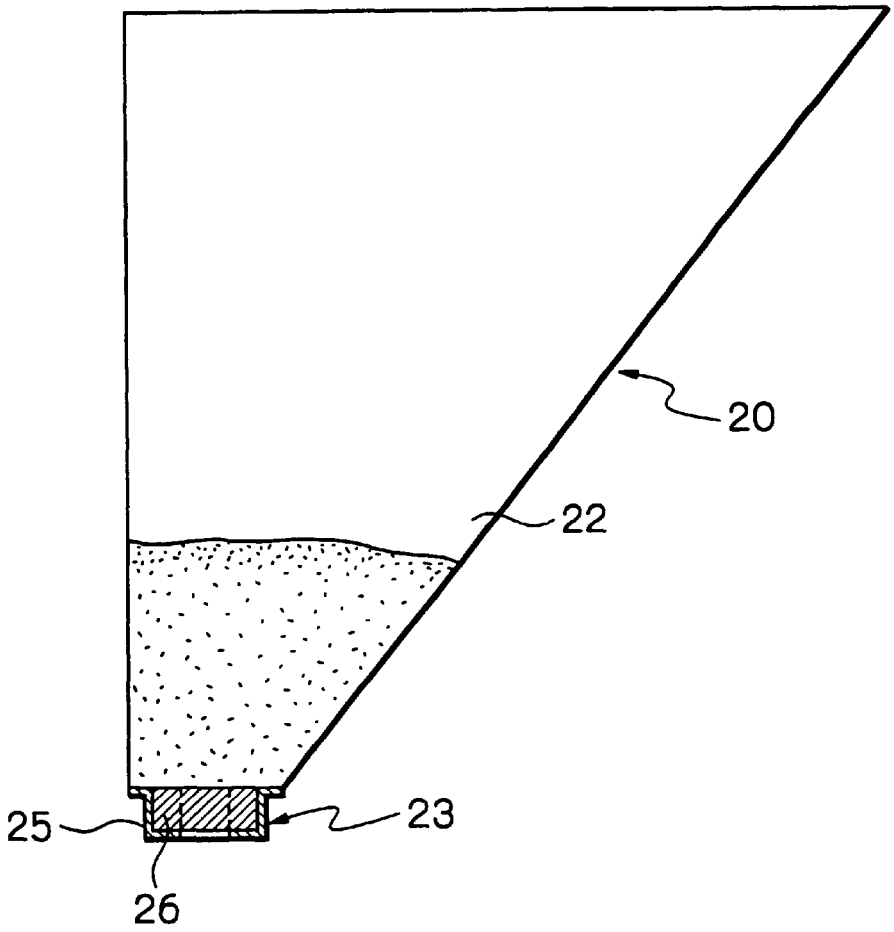
FIG. 12A is a sectional side elevation showing a toner container included in the alternative embodiment.
Figure 12B:
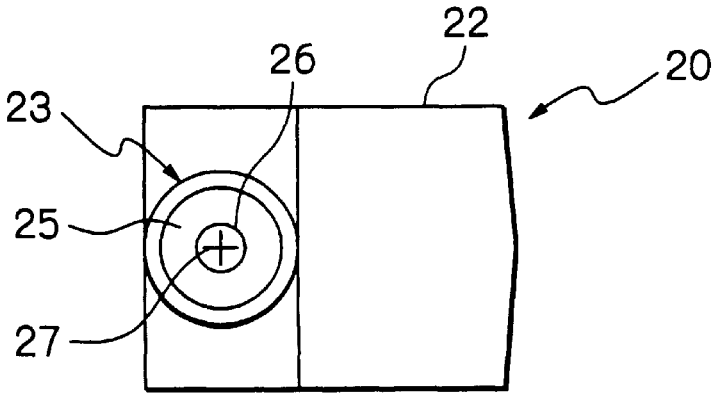
FIG. 12B is a bottom view of the toner container shown in FIG. 12A.
Figure 13:
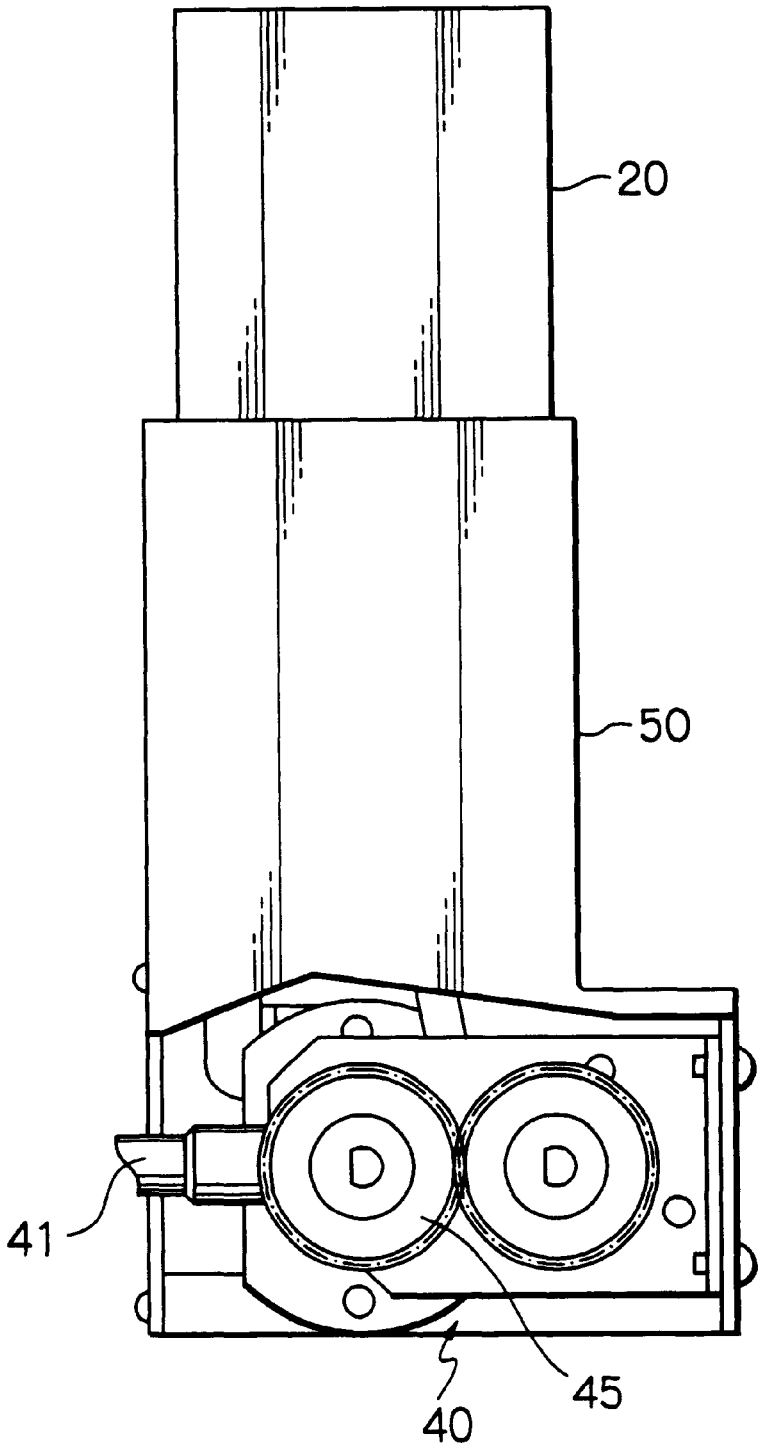
FIGS. 13 and 14 are side elevations showing the toner replenishing mechanism of FIG. 11 as seen from one side and the other side, respectively.
Figure 14:
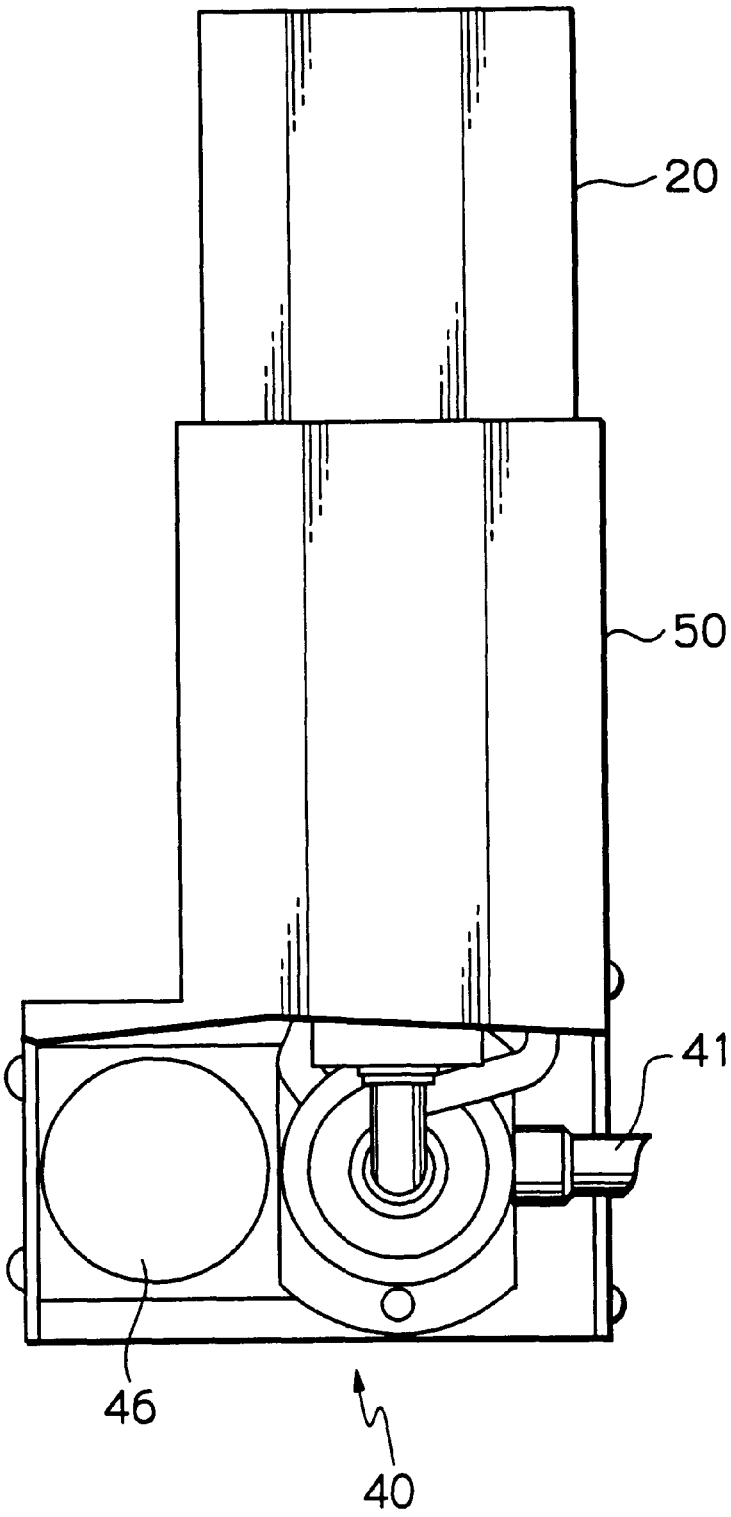

FIG. 11 shows essential part of the toner replenishing device. FIGS. 12A and 12B show the toner container 20 in a partly taken away, sectional view and a bottom view, respectively. FIGS. 13 and 14 are side elevations of the toner replenishing device of FIG. 11 as seen from one side and the other side, respectively.

As shown in FIG. 11, the mount portion 50 is formed of, e.g., resin and includes various members for supporting the toner container 20 and delivering the toner from the toner container 20 to the developing device 10. The nozzle 51 is formed of, e.g., resin and formed integrally with or removably mounted to the mount portion 50. The toner discharge passage 54 extends throughout the nozzle 51.

Specifically, the mount portion 50 includes an air pump or air feeding means 30 and the powder pump 40. The air pump 30 is communicated by a pipe 31 to an air inlet 48 formed in part of a support member 47 that supports the powder pump 40. The powder pump 40 is identical with the powder pump 40 of the previous embodiment and will not be described specifically in order to avoid redundancy. Briefly, when the rotor 42 is rotated, the toner is delivered from the toner inlet side of the holder 44 to a toner outlet 49 formed in the support member 47 by suction. The toner then flows to the developing device 10 via the tube 41 together with air fed under pressure from the air pump 30. A gear 45 causes the rotor 42 to rotate.

The toner container 20 includes the bag 22 and mouth member 23 attached to one end of the bag 22. The bag 22 is generally triangular as seen in a side elevation. The bag 22 is implemented by a flexible sheet or a laminate of flexible sheets formed of polyethylene, nylon or similar resin or paper. The bag 22 is about 80 $\mu$m to about 125 $\mu$m thick. Aluminum should preferably be deposited on the surface of the bag 22 in order to cope with static electricity and moisture.

As shown in FIGS. 12A and 12B, the mouth member 23 is made up of the body 25 and seal member 26 as in the previous embodiment. As shown in FIG. 12B, a cruciform through slit 27 is formed in the center of the seal member 26.

Figure 15A:
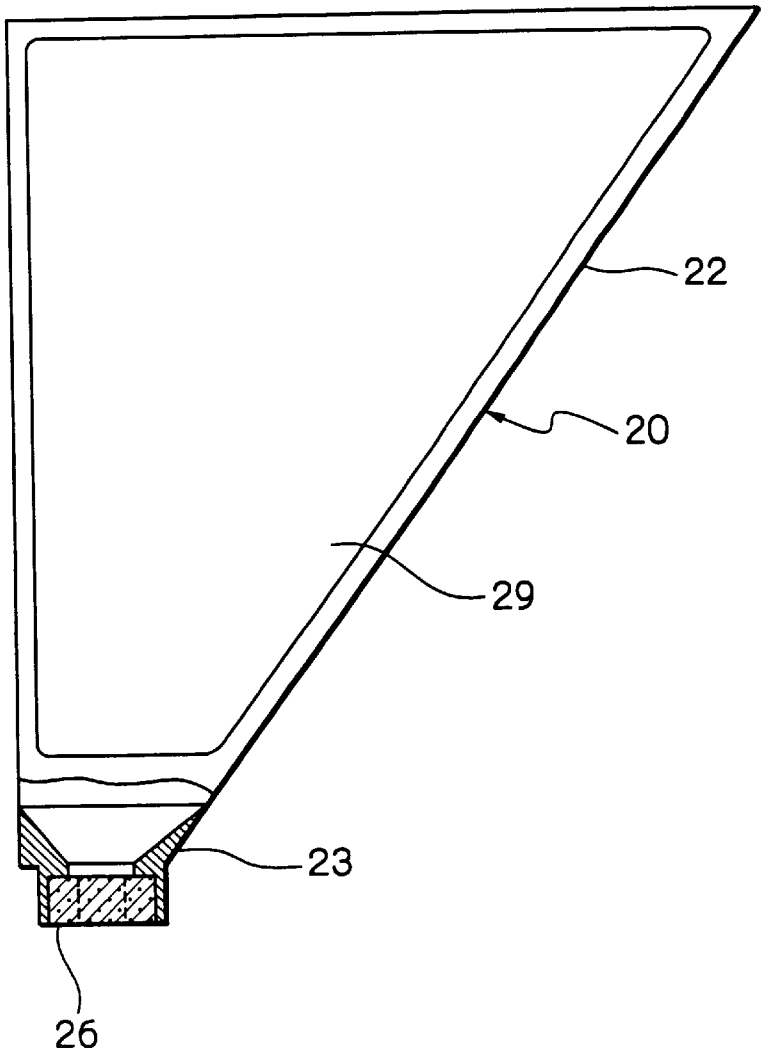
FIG. 15A is a sectional side elevation showing a modification of the toner container.
Figure 15B:
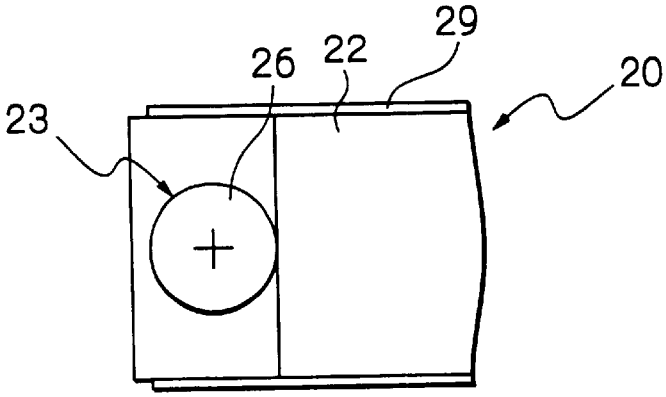
FIG. 15B is a bottom view of the modified toner container shown in FIG. 15A.
Figure 16A:
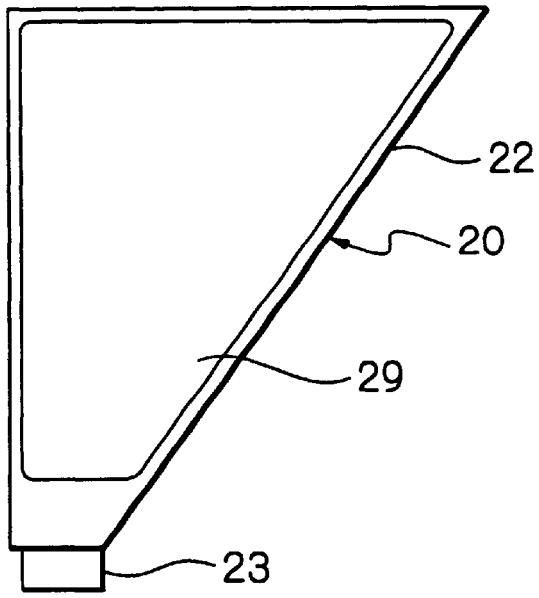
FIG. 16A is a side elevation showing the toner container of FIGS. 15A and 15B packed with toner.
Figure 16B:
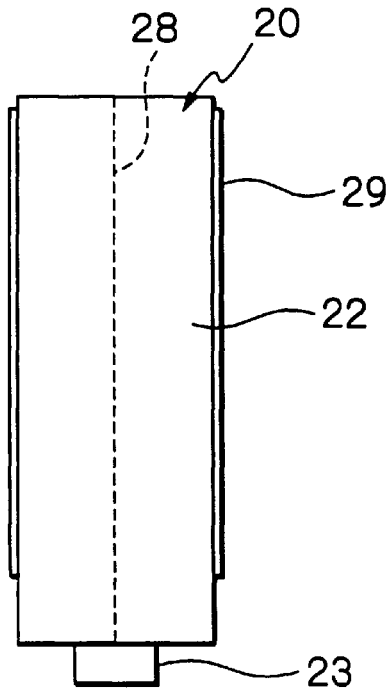
FIG. 16B is a front view of the toner container shown in FIG. 16A.

FIGS. 15A and 15B show a modification of the toner container 20 in a partly taken away, sectional side elevation and a bottom view, respectively. As shown, the modified toner container 20 has the hermetic bag 22 implemented by a 100 $\mu$m thick, flexible sheet formed of polyethylene and framed in a paper folding fashion. As shown in FIGS. 16A and 16B, contiguous folds 28 are formed at the centers of the top and opposites short sides of the bag 22 such that the bag 22 is foldable along the folds 28. The bag 22 has a funnel-shaped lower end portion extending downward to the toner outlet. A sheet-like reinforcing member 29 is formed of polyethylene and adhered to each of opposite triangular sides of the bag 22. Each reinforcing member 29 is 1 mm thick.

FIGS. 16A and 16B show the toner container 20 filled with the toner. When the toner is sucked from the toner container 20 set on the mount portion 50, it flows from the toner inlet 53 formed in the tip portion 52 of the nozzle 51 to the developing device 10 via the toner discharge passage 54 due to its own weight and the operation of the powder pump 40. Every time the toner is replenished, pressure inside the toner container 20 drops. The flexible bag 22 is formed of a material that deforms when subjected to pressure lower than the suction pressure of the powder pump 40. The volume of the bag 22 therefore decreases in accordance with the above-mentioned pressure drop in order to balance the pressure inside the bag 22 and the atmospheric pressure.

Figure 17A:
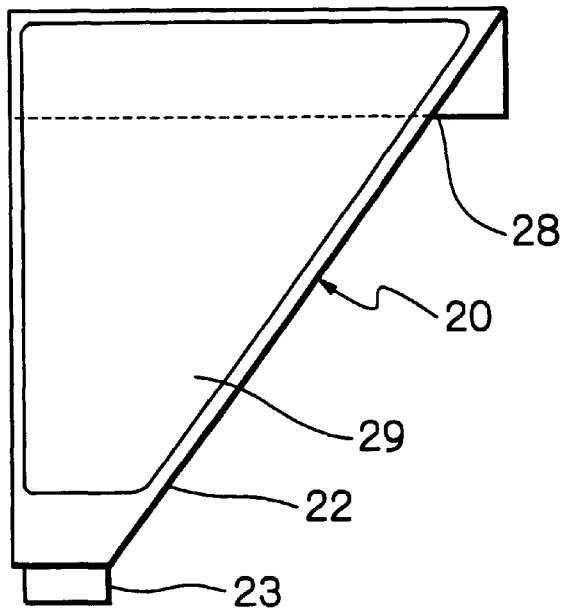
FIG. 17A is a side elevation showing the toner container of FIGS. 15Aa and 15B in a substantially empty condition.
Figure 17B:
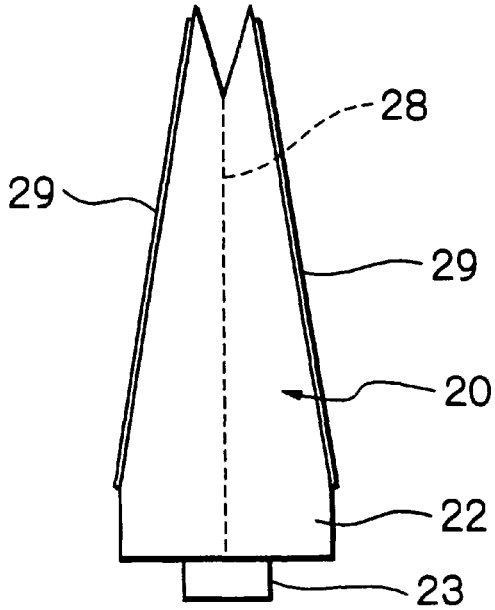
FIG. 17B is a front view of the toner container shown in FIG. 17A.

The bag 22 is flexible while the non-flexible mouth member 23 and reinforcing members 29 are attached to the bag 22. In addition, the folds 28 allow the sides of the bag 22 to which the reinforcing members 29 are adhered to easily move inward, i.e., toward each other. Consequently, as shown in FIGS. 17A and 17B, the bag 22 folds along the folds 28 and decreases in volume little by little due to the repeated pressure drop. The reinforcing members 29 move toward each other with their lower ends serving as a fulcrum while preserving the shape. Therefore, the toner in the bag 22 smoothly flows because of the decreasing volume and its own weight without staying in the bag 22. At the same time, the toner fills up a space in the bag 22 from which the toner has been discharged.

Again, the toner in the bag 22 is free from mechanical stresses that would cause the toner to cohere. Further, even toner low in fluidity does not bridge in the toner container 20. The property of the toner can therefore be maintained stable without regard to the amount of the toner existing in the bag 22, insuring stable toner replenishment at all times. Further, the entire toner can be discharged from the bag 22. Moreover, when the bag 22 is emptied, the volume of the bag 22 is far smaller than when packed with the toner.

The reinforcing member 24 moves inward with its lower portion serving as a fulcrum while preserving the shape, as stated earlier. The reinforcing member 24 therefore preserves the space in the lower portion of the bag 22 in the event of pressure drop and does not obstruct the discharge of the toner at all. In addition, because the reinforcing members 29 are rigid, the toner container 20 can be easily mounted and dismounted from the mount portion 50.

In the illustrative embodiment, a control circuit, not shown, selectively feeds power from a power source, not shown, to the air pump 30 and powder pump 40 via a switch not shown. The control circuit may be implemented by any one of conventional circuitry.

The powder pump or single axis, eccentric screw pump 40 is capable of continuously delivering a preselected amount of powder with a high solid-to-air ratio in proportion to the rotation speed of its rotor, as well known in the art. Therefore, the amount of toner replenishment can be controlled in terms of the duration of operation of the powder pump 40. The sucking force of the powder pump 40 depends on the shape of the stator and the rotation speed of the rotor. A member for conveying the powder can be laid in any desired position, e.g., a relatively high position in any desired direction, i.e., upward, downward, rightward or leftward.

The timing for driving the powder pump 40 and the timing for driving the air pump 30 are important in the aspect of reliable toner delivery. Specifically, the air pump 30 should start feeding air before the powder pump 40 starts sucking the toner, so that the toner can be stably delivered without staying in the tube 41.

The maximum flow rate of air should only be as low as 1 l/min to 2.0 l/min in a no load condition. Such air can be easily discharged from, e.g., the developing device 10 without causing the toner to fly about.

Air does not have to be constantly sent to the toner container 20, but maybe sent only when, e.g., power supply to the printer begins, when the toner container 20 is replaced or when a preselected number of copies or prints are produced. The crux is that air be fed to the toner container 20 in an amount and at a timing that are optimal for the kind (property) of toner used and the capacity of the toner container 20.

Powdery toner customarily applied to an electrophotographic image forming apparatus lacks fluidity and is difficult to convey, as well known in the art. Toner should not be subjected to heavy mechanical stresses during conveyance. Unusual stresses cause the toner to cohere due to heat (toner blocking) or to be crushed. This not only varies the property of toner and obstructs the conveyance, but also damages conveying members, e.g., coils, screws and pipes as well as drive members. It is therefore necessary to protect toner from unusual mechanical stresses as far as possible during conveyance.

A conventional toner replenishing device, using a screw and a pipe, subjects toner to considerable mechanical stress ascribable to the screw and mechanical stress ascribable to friction between the screw and the pipe. Such mechanical stresses increase as the distance of conveyance increases or as the direction of conveyance is varied. Moreover, a torque necessary for driving the screw increases to a noticeable degree, increasing the cost of a drive member and power consumption.

For the reasons described above, to extend the distance of conveyance or to change the direction of conveyance, it has been customary to use a plurality of screws and a plurality of pipes connected together in multiple stages. Such screws and pipes further vary the property of toner, increase the number of parts as well as cost, degrades reliability, maintenance and productivity, increases the space to be allocated to the toner replenishing device, and obstructs easy operation.

In accordance with the present invention, the toner container 20 needs only a simple self-closing valve attached to a toner storing member or bag and is therefore simple in configuration. In addition, the self-closing valve allows the toner container 20 to be easily replaced without causing the toner to fly about and contaminate surroundings.

Because the suction type powder pump 40 sucks the toner out of the toner container 20, a minimum of toner remains in the container 20. The toner 20 is therefore economical and can be safely and sanitarily handled after used.

The bag 22, which is flexible, is far smaller and therefore easier to handle than the conventional cartridge, bottle or similar hard case and occupies a minimum of space during transport or storage. The used toner container 20 is collected from the user's station by the manufacturer and recycled, reused or burned. In this respect, the toner container 20 can be easily rolled up or folded up because only the mouth member 23 is hard. This further enhances the easy transport and storage of the bag 22 while reducing the space to be allocated to the bag 22. In addition, the cost of collection of the bag 22 from the user's station is noticeably reduced.

Only a flexible pipe is used to connect the toner replenishing device to the developing device 10, so that the toner is prevented from flying about. Further, the toner replenishing device can be arranged at any desired place without regard to the position of the developing device 10. More specifically, the toner replenishing device can be located at a position that is easiest to access for the replacement of the toner container 20.

The suction type powder pump allows the toner replenishing device to accurately replenish the toner. In addition, because a valve is absent in the toner conveyance path, the toner can be stably conveyed without stopping up the path, enhancing the durability of the toner replenishing device.

The toner is conveyed via the tube 41 together with air and therefore subjected to a minimum of mechanical stress. At the same time, a conveying member does not need any extra drive load. This is successful to enhance the reliability and durability of the toner replenishing device, to simplify the toner replenishing device, and to lower the drive load and therefore power consumption and cost.

While the illustrative embodiments have concentrated on a two-ingredient type developer, the present invention is similarly practicable with a single-component type developer, i.e., toner. Also, while the nozzle 51 has a circular cross-section, it may alternatively have an oblong or even a polygonal cross-section. As for a polygonal cross-section, the nozzle 51 should preferably have an equilateral polygonal cross-section having rounded corners.

In summary, it will be seen that the present invention provides an image forming apparatus and a toner container therefor having various unprecedented advantages, as enumerated below.

(1) When the toner container runs out of toner, it automatically decreases in volume and causes a minimum of toner to remain therein.

(2) The toner container can surely decrease in volume and can therefore be collected by the manufacturer at a remarkably low cost.

(3) Toner sucking means surely reduces the volume of the toner container by suction and also implements the above advantage (2).

(4) The toner container is easy to handle and store despite that it can reduce its volume.

(5) The volume of the toner container surely decreases with regularity.

Various modifications will become possible for those skilled in the art after receiving the teachings of the present disclosure without departing from the scope thereof.

What is claimed is:

1. An image forming apparatus comprising:

a developing device for developing a latent image formed on an image carrier with toner; and a toner replenishing device for replenishing toner from a toner container to said developing device;

wherein said toner container is deformable and hermetic and formed with a toner outlet; and wherein said toner replenishing device includes sucking means for sucking the toner out of said toner container, while causing walls of said toner container to move in such a manner as to reduce a volume of said toner container, thereby minimizing bridging and caking of said toner.

2. The image forming apparatus as claimed in claim 1, wherein said sucking means comprises a suction type, single-axis eccentric screw pump.

3. The image forming apparatus as claimed in claim 2, wherein said toner container is formed of a material deformable when subjected to suction of said sucking means.

4. The image forming apparatus as claimed in claim 2, wherein said toner container is provided with tendency to deform when subjected to suction of said sucking means.

5. The image forming apparatus as claimed in claim 1, wherein said toner container is formed of a material deformable when subjected to suction of said sucking means.

6. The image forming apparatus as claimed in claim 1, wherein said toner container is provided with tendency to deform when subjected to suction of said sucking means.

7. In a toner container for an image forming apparatus comprising a developing device for developing a latent image formed on an image carrier with toner, and a toner replenishing device for replenishing toner from said toner container to said developing device, said toner container comprises a body while said toner replenishing device comprises sucking means for sucking toner out of said body, said body being hermetic and deformable when subjected to suction of said sucking means, for minimizing bridging and caking of said toner.

8. The toner container as claimed in claim 7, wherein said toner container further comprises a protection case more rigid than said body for accommodating said body.

9. The toner container as claimed in claim 7, wherein said body is formed of a material deformable when subjected to the suction of said sucking means.

10. The toner container as claimed in claim 9, wherein said toner container further comprises a protection case more rigid than said body for accommodating said body.

11. The toner container as claimed in claim 7, wherein said body is provided with tendency to deform when subjected to suction of said sucking means.

12. The toner container as claimed in claim 11, wherein the tendency to deform is implemented by folds that cause said body to fold when subjected to the suction of said sucking means.

13. The toner container as claimed in claim 12, wherein said body folds in a direction in which facing side walls thereof approach each other.

* * * * *